United States Patent [19]

Arff

[11] Patent Number: 4,698,923

[45] Date of Patent: Oct. 13, 1987

[54] CLEAT SYSTEM FOR SPORTS SHOES, ESPECIALLY FOOTBALL SHOES

[75] Inventor: Heino Arff, Norderstedt, Fed. Rep. of Germany

[73] Assignee: ITW Ateco GmbH, Norderstedt, Fed. Rep. of Germany

[21] Appl. No.: 799,148

[22] Filed: Nov. 18, 1985

[30] Foreign Application Priority Data

Dec. 1, 1984 [EP] European Pat. Off. ..... 84114627.7
Jul. 13, 1985 [EP] European Pat. Off. ..... 85108772.6

[51] Int. Cl.[4] ..... A43B 5/02

[52] U.S. Cl. ..... 36/128; 36/134; 36/66; 36/62

[58] Field of Search ..... 36/67 D, 62, 64, 67 R, 36/134, 59 R, 126, 128, 127, 66

[56] References Cited

U.S. PATENT DOCUMENTS

| | | | |
|---|---|---|---|
| 2,294,462 | 9/1942 | King et al. | 36/67 D |
| 2,302,471 | 11/1942 | Pierce et al. | 36/67 D |
| 2,306,308 | 12/1942 | Goldenberg | 36/67 D |
| 2,309,783 | 2/1943 | Park | 36/67 D |
| 2,343,007 | 2/1944 | Goldenberg | 36/67 D |
| 2,689,417 | 9/1954 | Bernstein | 36/67 D |
| 2,745,197 | 5/1956 | Holt | 36/67 D X |
| 3,267,593 | 8/1966 | Turner | 36/67 D |
| 4,035,934 | 7/1977 | Hrivnak | 36/67 D |
| 4,357,763 | 11/1982 | Fleischmann et al. | 36/67 D |
| 4,366,632 | 1/1983 | Bente | 36/67 D |
| 4,414,763 | 11/1983 | Bente | 36/67 D X |
| 4,445,288 | 5/1984 | Frör | 36/67 D X |
| 4,492,047 | 1/1985 | Arff | 36/134 |

*Primary Examiner*—Stephen Marcus
*Assistant Examiner*—T. Graveline
*Attorney, Agent, or Firm*—John P. O'Brien; Thomas W. Buckman

[57] ABSTRACT

A cleat system for sports shoes, especially football shoes, comprising a downward opening socket in the outsole, provided with at least two circumferentially spaced first supporting surfaces at the inside thereof facing away from the socket opening, a cleat body, a fastening portion connected to the cleat body through which the cleat body is adapted to be detachably connected to the socket and which has at least two circumferentially spaced mounting surfaces integrally formed thereat facing the cleat body which upon insertion and after rotation of the fastening portion through a predetermined angle of rotation come to lie against the first supporting surfaces substantially under surface contact, a further mounting surface formed integrally with the cleat body which comes to lie against the outsole under pressure from below when the supporting and mounting surfaces are in engagement with each other, and locking means effective between the fastening portion and the socket which resists a backward rotational movement of the fastening portion after having been turned in, with a contact surface portion of mounting and supporting surfaces disposed between the extremities in the circumferential direction being spaced from the axis respectively of the cleat body or the socket through a greater or smaller radial distance than the remaining contact surfaces.

1 Claim, 17 Drawing Figures

CLEAT SYSTEM FOR SPORTS SHOES, ESPECIALLY FOOTBALL SHOES

The invention relates to a cleat system for sports shoes, especially football shoes, comprising a downward opening socket in the outsole provided with at least two circumferentially spaced first supporting surfaces inside thereof and facing away from the socket opening, a cleat body, a fastening portion connected to the cleat body through which the cleat body may be detachably connected to the socket, with at least two circumferentially spaced mounting surfaces formed integrally with said fastening portion facing the cleat body which, upon insertion and after rotation of the fastening portion through a predetermined angle come to lie essentially under surface pressure against the first supporting surfaces of the socket, a further mounting surface formed integrally with the cleat body and coming to lie against the outsole under pressure from below when the supporting and mounting surfaces are in engagement with each other, and a means for preventing unintentional rotation between the fastening portion and the socket.

Such a cleat system is known (German disclosure letter 32 42 606). The supporting and mounting surfaces of socket and fastening portion are formed by two diametrically opposed ball socket and surface portions, respectively. Furthermore, integrally shaped with the fastening portion are diametrically opposed projections which are introduced through axial slots formed in the socket and guided over a ramp surface when a rotational force is applied to the cleat body. In this arrangement the cleat body is pressed against the outsole, said pressing force being maintained in a sufficient degree when the projections are relieved of the axial power in the final position of rotation. Relative to the contact pressure force on the sole the supporting surfaces in the socket are now effective as a counter abutment.

With the aid of such a construction the cleats including the fastening portion may be integrally formed of synthetic material. In this manner, it is possible to reduce the overall weight of a sports shoe. Furthermore, with such a cleat the danger of injuries is reduced which with conventional sports shoes is brought about after a good deal of wear by sharp-edged steel pins through which the cleat body is adapted to be screwed in into the threaded inserts of the sole. The relatively large area mounting and supporting surface of fastening attachment and socket come to lie against each other under pressure and are able to accommodate high forces both in pull-out and transverse directions. With a relatively soft elastic material for the cleats the ball surfaces in addition allow a limited rocking movement of the cleat body.

The nose-like projections at the fastening portion already mentioned not only lead to a bias between the mounting and supporting surfaces but at the same serve as locking means against unintentional backward rotation. Only after the application of a predetermined torque it is possible to turn the fastening portion back into the position of introduction, in order to remove the cleat. But it may happen that the projections become deformed permanently during the turning-in (operation), and do not guarantee safety against rotation in a sufficient degree as desired.

It is therefore the object of the invention to provide a replaceable cleat for sports shoes, especially football shoes, largely formed of synthetic material which comprises an effective means to afford safety against unintentional rotation.

In accordance with the invention this object is attained in that a contact surface area of mounting and supporting surfaces disposed between the extremities in the circumferential direction is spaced from the axis respectively of the cleat body and the socket through a greater or smaller radial distance than the remaining contact areas.

In the invention it has been recognized that the supporting and mounting surfaces proper may be utilized as locking means preventing unintenional rotation. If assembled, these surfaces are to lie possibly snug against each other so that a power transfer may take place over a large surface area. In one embodiment of the mounting and supporting surfaces according to the invention when rotating the fastening portion after insertion a certain resistance must be overcome first, in order to bring the mounting and supporting surfaces to coincide after an angle of rotation. In this manner, an effective locking means is provided. It may replace the previous locking means with the aid of the projections at the fastening portion or may supplement the function thereof as a locking means preventing rotation of the assembled cleat.

Preferably, the contact area having greater or smaller distance is disposed approximately midway between the extremities. It is clear that in an axial direction the contact surface area of greater or smaller distance may extend over the entire area of contact and support, respectively, or also only over part thereof.

The mounting and supporting surfaces may be designed as cylindrical, conical or spherical surfaces. In this connection it is advantageous if, in accordance with the invention, the radius of the mounting and supporting surfaces is smallest at the ends and gradually increases towards the central region. Particularly advantageous is a cross sectional configuration such that the supporting and mounting surfaces have different radii with the centers of circles offset such that the circular arcs in the center region approximately coincide but towards the ends increasingly deviate from each other. With respect to the axis, thus, the surfaces of a circularly arcuate cross sectional configuration are arranged eccentrically.

The shape of the mounting and supporting surfaces designed according to the invention is particularly advantageous when formed in a manner known per se as spherical surface or spherical socket portions, respectively.

Upon rotation of the fastening portion in the socket the mounting surface may more or less easily pass over into the supporting surface, with the resistance, however, progressively increasing until it reaches a maximum value. Thereby, a transient resilient deformation of the mounting and supporting surfaces, respectively, is brought about which, however, due to the resilient properties of the material will resume their shape when the mounting and supporting surfaces come to lie in snug contact against each other in the final position of rotation.

The locking means is still improved if the spherical surface and/or socket sections have a relatively rough surface.

It has already been explained that it is known to form projections or taps integrally at the fastening portion of the cleat, which form a bayonet-type catch with the socket. When the ramp surfaces along which the projections move when the fastening portion is turned in into the socket, slope downward again after having reached a maximum, a locking means against rotation in opening direction may also be obtained in this manner as already described. But if the projections are to take over also a supporting function, the locking means possibly is insufficient. Therefore, in accordance with an alternative embodiment of the invention, an elastically yielding elevation is formed in the socket which is respectively disposed between an abutment surface and the axial insert slot in the socket. When the fastening portion is rotated after having been introduced through the insert slots, the elevations are elastically deformed by the projections, until the projections enter the space between the elevations and the abutment surfaces. The deformation eliminates so that, now, the elevations are forming locking means against rotation. This locking means against rotation may under certain circumstances be sufficient and, therefore, may supplement the locking means against rotation described above. It is clear that both locking means may be used jointly.

A safe fit of the fastening portion in the socket is obtained when the contour of the projections is such that they are more or less positively seated in the space between elevation and abutment surface. If the outer contour of the elevation is circularly arcuate, which is particularly advantageous, the projection will have a hollow groove for the elevation to become snugly placed therein when the opposite surface of the projection is in close contact with the abutment surface. In order to improve the flexibility of the elevation, it is advantageous in accordance with the invention to relieve the elevation by a paraxial recess. The forward edge of the projection which is the first to get into engagement with the elevation advantageously is sufficiently rounded, in order to prevent plastic deformation or expansion of the material.

If a suspension of the cleat in the outsole is to be obtained with a slight degree of a rocking effect, the projections of the fastening portion must not be fixed. It has, however been found that it is more advantageous if the projections for their part are made use of for supporting purposes. The underside of the projections will then form another mounting surface which cooperates with a corresponding supporting surface of the socket. With this embodiment of the invention the projections are designed to be relatively strong and may extend over an arc subtending an angle of about 60° to 70°.

If the projections take over a supporting function, it is to the purpose according to another embodiment of the invention to form the first supporting surfaces which are configured as spherical-sectional surfaces only below the projections. Furthermore, such a spherical-sectionally shaped mounting surface may be defined by a radial surface on the underside thereof which cooperates with a radial third supporting surface between the slot and the abutment surface.

As already stated, the mounting and supporting surfaces largely accommodate the forces which are transferred from the cleat body to the shoe. In order to in part relieve the mounting and supporting surfaces from the forces to be accommodated, provision is made in another embodiment of the invention for the cleat body to comprise a cylindrical or conical, preferably circularly extending seat portion below the mounting surface of the fastening attachment, which cooperates with a corresponding cylindrical or conical portion of the sole.

The forces acting on the cleat substantially axially are not critical. Laterally engaging forces may develop substantial torque and bending forces, respectively, and may impair the fit of the fastening portion in the sole. A cylindrical or conical supporting surface of the sole which cooperates with a corresponding surface of the cleat body, in this arrangement, transfers lateral forces directly on to the sole and thus relieves the fastening portion. In this connection, another embodiment of the invention is advantageous in which radial, preferably circularly circumferentially extending abutment sections are formed above and/or below the cylindrical or conical portion which cooperate with corresponding radial abutment portions of the sole.

Screw type cleats of known construction comprise external circumferentially spaced paraxial recesses for corresponding projections of a socket wrench engaging therein, in order to screw the cleat body in and out, respectively. With the cleat according to the invention the latter is not detached from the sole automatically during the process of turning out. Rather, a certain pulling force must be applied, in order to detach the fastening portion from the socket. Therefore, provision is made in one embodiment of the invention for circumferentially spaced recesses like bayonet slots to be formed in the cleat body with the undercut disposed at the upper end. Noses disposed in the socket wrench get into the undercut when the cleat is respectively turned in and out. For this purpose, the noses or radial extensions in the socket wrench have but a short axial length. They are preferably formed integrally with a metal ring which is embedded in the socket wrench otherwise made of synthetic material. It is possible with the aid of the noses engaging the undercuts to exert a pulling force on the cleat and to remove it from the sole. In the operation of assembling and disassembling the recesses prevent the wrench from slipping off. With known cleats the previously used grooves without undercut easily led to difficulties when screwing the cleats in and removing them.

The invention will be explained in the following in more detail by way of drawings.

Figure 1:
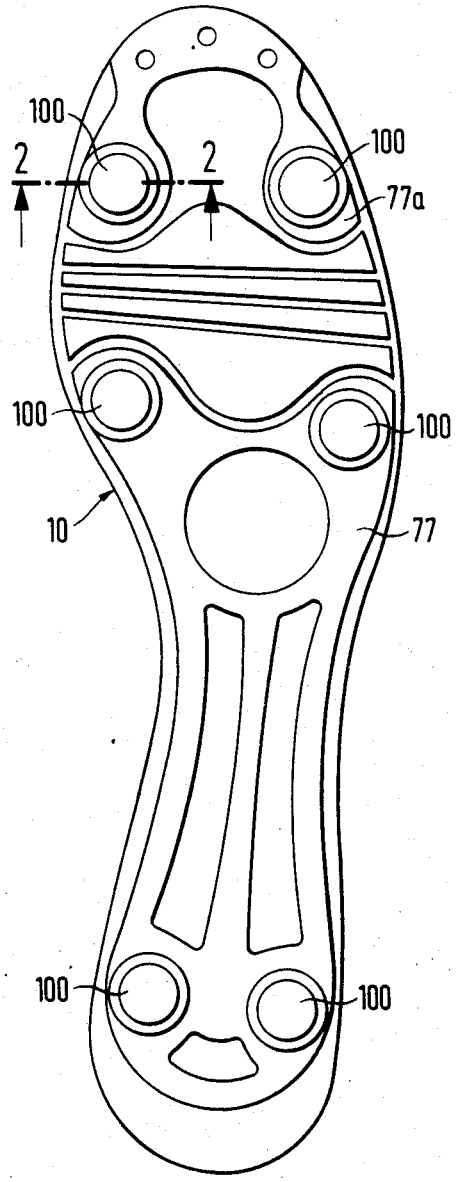
FIG. 1 shows a bottom plan view taken on a sole having cleats according to the invention.

In FIG. 1 a bottom plan view is shown taken on the outsole 10 of a football shoe from below which is formed by injection molding of synthetic material against the upper leather or in a separate operational step. When forming the sole 10, sole segments 77, 77*a* are placed into the mold before. They may be given a different colour. Sockets are formed integrally with the sole segments 77, 77*a* for the accommodation of cleats 100, which may respectively be inserted into and removed out of the socket in a manner still to be described.

The cleat 100 comprises a cleat body 101 and a fastening portion 18 which is formed integrally with the cleat body 101 of synthetic material. The fastening portion comprises two diametrically opposed spherical surface sections 20,21, which cooperate with the spherical socket portions 14, 15 of a socket formed in the sole segment 77*a*. Formed integrally with the fastening portion 18 above the spherical surface sections 20, 21 are diametrically opposed projections 22 and 23. They are accommodated by angular recesses 16, 17.

Figure 2:
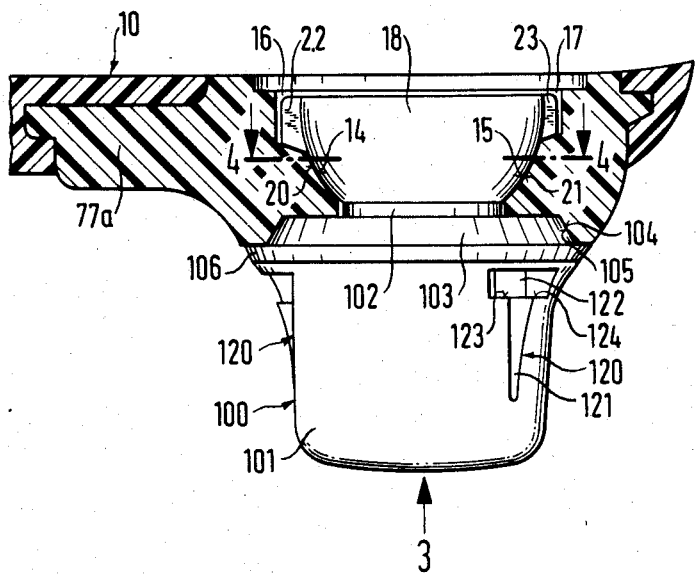
FIG. 2 shows a sectional view taken along line 2—2 of the representation according to FIG. 1.
Figure 5:
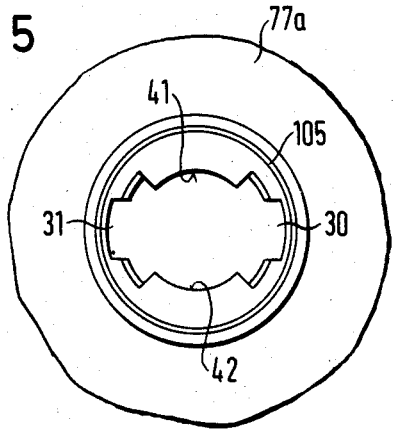
FIG. 5 shows a bottom plan view taken on the socket according to FIG. 2, without cleat.
Figure 7:
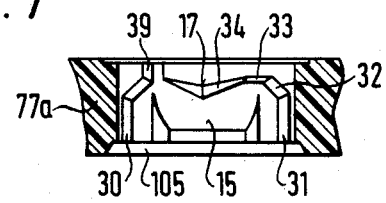
FIG. 7 shows a sectional view of the socket rotated through 90° relative to the illustration according to FIG. 6.
Figure 6:
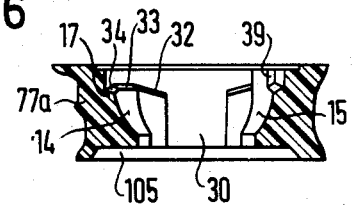
FIG. 6 shows a sectional view taken of a socket according to FIG. 2.
Figure 8:
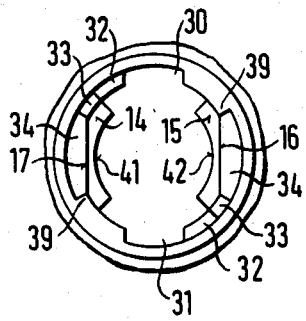
FIG. 8 shows a top plan view taken on the socket according to FIGS. 5 and 7.

Owing to the spherical surfaces 20, 21 the fastening portion approximately has the shape of a spherical section. From FIG. 5 the cross sectional contour of the fastening portion may be recognized which is shaped complementary to the lower opening of the socket shown. As will be noted at 41 and 42, respectively, the fastening attachment is part-cylindrical in shape. Arranged at a cylindrical neck portion 102 below the spherical surfaces 20, 21 is a conical portion 103 having a conical abutment surface 104 which cooperates with a corresponding conical seat surface 105 of the socket in the sole segment 77*a* (FIG. 2). The upper radial annular surface of the conical portion 103 comes to lie in close contact against a corresponding annular surface of the socket. Provided below the conical portion is another radial annular surface which comes to lie against a corresponding annular surface at the sole segment 77*a*.

As will be noted from FIG. 2, forces applied laterally or obliquely on the cleat 100 are in part accommodated by the conical surfaces 104, 105 as well as by the spherical surfaces 20, 21 and 14, 15, respectively. The projections 22, 23 at the fastening attachment 18 largely remain relieved.

The socket in the sole segment 77*a* for the receipt of the fastening portion 18 may be recognized in more detail from FIGS. 5 to 8. It comprises two diametrically opposed approximately paraxial slots 30, 31. Formed in the upper third of the slots 30, 31 on one side thereof are upward sloping ramp surfaces 32. Adjoining said ramp surfaces in a counterclockwise sense are horizontal or slightly inclined running surfaces 33. Following this are downward sloping ramp surfaces 34, which terminate at the recesses 16, 17 already mentioned.

The fitting on the cleats 100 into the sockets in the sole segment 77 or 77*a* is as follows: The cleat 100 is introduced into the socket formed the sole segment 77, 77*a* in such a manner that the projections 22,23 may be moved axially through the slots 30, 31. When the conical portion 103 is disposed in the corresponding recess in the sole segment 77*a* or the flange 106, respectively, of the cleat body is lying in close contact against the underside of the sole segment 77*a*, the underside of the radial projections 22, 23 has reached the upward sloping ramp surface 32. If, now, the cleat 100 is rotated a quarter turn in a clockwise sense, the projections 22, 23 will move along the associated ramp surface 32. In this manner, the cleat 100 is slightly drawn axially into the socket with a transient elastic deformation of the engaged members. With the rotation continued, the projections 22, 23 will subsequently arrive on the downward sloping ramp surface 34 so that the pressure between the parts will become slightly reduced but will still suffice for a sufficient compression pressure of the conical portion 103 and the flange 106 to be pressed against the associated sections of the sole segment 77*a*. The cleat 100 is now rotated further until the projections 22, 23 are aligned with respect to the angular recesses 16, 17. The projections 22, 23 may get into snapping engagement in the recesses 16, 17 in order to define the rotational position.

Figure 4:
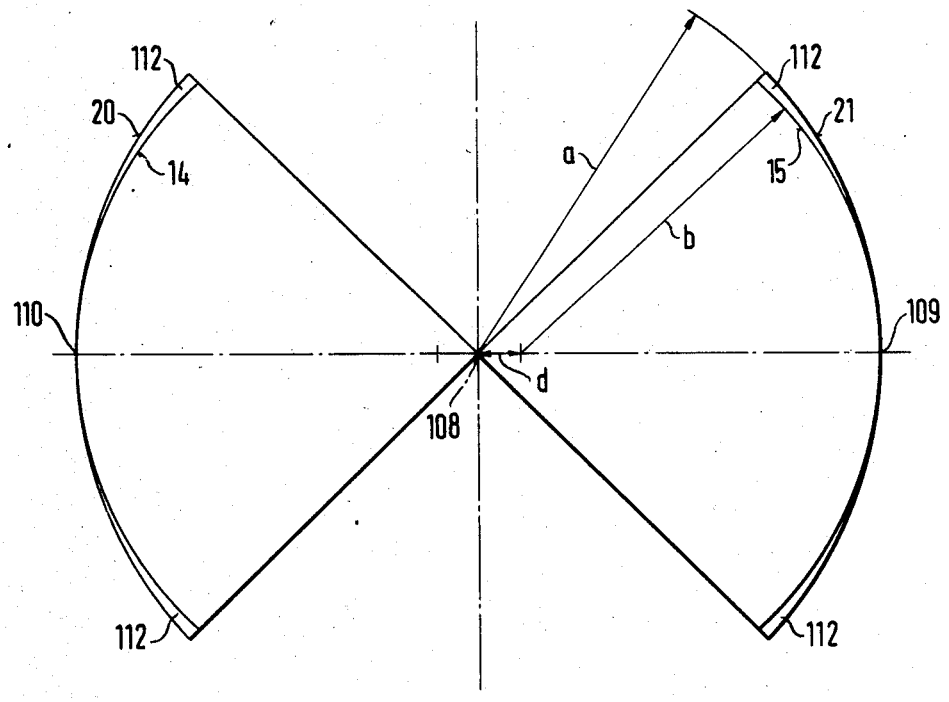
FIG. 4 shows an extremely schematic sectional view taken along line 4—4 of the cleat and socket according to FIG. 2.

The described arrangement in the assembled condition has for a result that the spherical surfaces 20, 21 come to lie in snug engagement against the ball socket portions 14, 15. Abutments 39 in the socket prevent overturning of the fastening attachment 18 by the projections 22, 23 running up against them. The spherical surfaces 20, 21 of the fastening portion 18 and the ball socket surfaces 14, 15 of the socket are slightly deviating from the mathematical shape of a ball surface. This may be seen from FIG. 4. FIG. 4 shows the radii of the surfaces and the distance, respectively, thereof from the central axis in a transverse sectional plane (FIG. 2). The axis is designated with 108 and, with a mathematically exact shape of a circle, the result in cross section is the radius a. The corresponding surfaces of the fastening portion and the socket, however, approximately have the radius a only in the central region between the ends (looking in the direction of rotation) as indicated at 109 and 110, respectively. From these points the distance decreases towards the extremities, because the radius with which the circular arc is drawn (radius b) is spaced from the axis 108 through a certain distance d. Between the circular arcs drawn with the radii a and b there result, thus, four narrow differential surfaces 112 in an arcuate triangular shape.

During the phase of fitting the cleat 100 the mounting surfaces 20, 21 are disposed in the gaps between the supporting surfaces 14, 15. If the fastening portion 18 as already described above, has been sufficiently introduced axially, the entire cleat will be rotated. In this connection, the mounting surfaces 20, 21 are first running smoothly into the socket surfaces 14, 15. With rotation continued the section of the mounting surfaces 20, 21 respectively entering into the socket surfaces 14, 15 has a progressively increasing diameter. The maximum difference will occur when the central region of the mounting surfaces has to pass the entrance of the socket surfaces. The turning-in of the mounting surfaces 20, 21 into the socket surfaces 14, 15, therefore, may take place through elastic deformation of the material. As the material of the socket and the cleat is flexible, a return deformation will occur immediately the deforming forces cease to be effective. This is the case when the mounting surfaces 20, 21 are disposed completely within the socket surfaces 14, 15. In this condition, the mounting surfaces 20,21 are lying snugly against the socket surfaces 14, 15. It will be noted that rotation of the mounting surfaces 20, 21 or a rotational movement to turn them out of the socket surfaces 14, 15 may take place only while newly deforming the above-described members. Thus, the fastening attachment 18 is seated in the socket in a rotationally fixed position.

Figure 3:
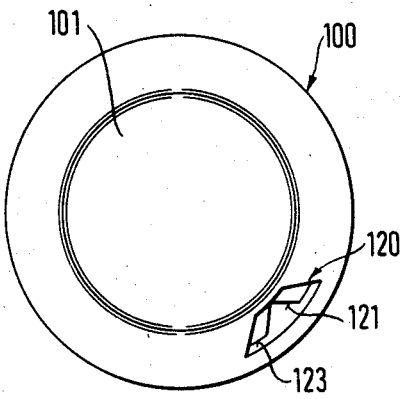
FIG. 3 shows a bottom plan view taken on the representation according to FIG. 2.

From FIG. 2 it will be seen that recesses are formed at the circumference of the cleat body for applying a tool. Provided altogether are three recesses 120 equally spaced circumferentially, only one of them being shown in FIG. 3. The recesses 120 are provided with an approximately paraxial groove 121 of triangular cross section which is deepening and widening upwardly corresponding to the increased radial extent of the cleat body 101. The base line of the groove in this arrangement is spaced from the axis 108 through the same distance. The groove 121 terminates at the upper end in a transverse recess 122, whereby shoulders 123, 124 are formed.

In the embodiment according to FIGS. 9 to 14, parts which are the same as those in the preceding embodiment are provided with the same reference numbers, however, with a miniscule b added to the reference numeral.

A cleat **100*b* consisting of a cleat body 101*b* and a fastening portion 18*b*, is seated in a socket of a sole portion 10*b*. Formed in the cleat body 101*b* at three places cicumferentially offset through 120° are a paraxial longitudinally extending groove 121*b* and a peripheral groove 122*b* (see also FIGS. 2 and 3). The two shoulders 123*b*, 124*b* are formed by the transverse recess 122*b*. The paraxial groove 121*b* is provided with flattened marginal edges, with the flattening becoming wider towards the peripheral recess 122*b*, as shown at 150*b***.

The cleat body **101*b* enlarges conically towards the sole 10*b* and forms a flange 106*b*, which comes to lie in close contact against the underside of the sole 10*b*. Fitted in a conical annular recess 105*b* in the sole 10*b* is a conical extension 103*b* of the fastening attachment 18*b* which is less in diameter. As will be seen from FIG. 10, the fastening portion 18*b* is cylindrically shaped at diametrically opposed areas as shown at 41*b*, 42*b*, with a length of arc of more than 90°. Formed integrally at the fastening portion 18*b* are diametrically opposed projections 22*b*, 23*b*. They are provided with a flat underside 151*b*. The journals 22*b*,23*b* are approximately trapezoidal in cross section (see FIG. 10). The outer surface thereof is circularly shaped as shown at 152*b*. The one outer edge is strongly rounded off at 153*b*. At the other edge a groove 154*b* is formed. Mounting surfaces 20*b*, 21*b* in the form of spherical sections are formed immediately beneath the radial projections 22*b*,23*b*. They terminate below in a radial supporting surface 155*b***.

Details of the socket in the sole **10*b* may be seen from FIGS. 11 to 14. From the bottom plan view taken on the socket according to FIG. 11 it may be recognized that the recess 105*b* extends over two diametrically opposed sectors corresponding to the length of arc of the cylindrical sections 41*b* and 42*b* of the fastening portion 18*b*. Located between the sectors of the recess 105*b* are the insert slots 30*b*, 31*b* in diametrically opposed arrangement. In this manner, an insert opening is defined which is approximately in congruent with the contour of the fastening portion 18*b* (see FIG. 10). From FIGS. 12 and 14 it may be derived that the insert slots 30*b*, 31*b* are laterally joined on one side thereof by an obliquely upward sloping ramp surface 32*b*. Said ramp surface rises up to a surface 156*b* extending approximately horizontally. Formed beneath the supporting surfaces 14*b*, 15*b* is another supporting surface 157*b* which extends from the insert slot as far as the abutments 39*b* radially projecting into the recess of the socket and defining the insert slots 30*b*, 31*b* towards the other side. As will be seen from FIGS. 10 and 14, radial elevations 158*b* are formed in the transit region between the ramp surface 32*b* and the supporting surface 156*b* having a circular-shaped contour in cross section. Paraxial bores 159*b* relieve the elevations 158*b***.

Figure 9:
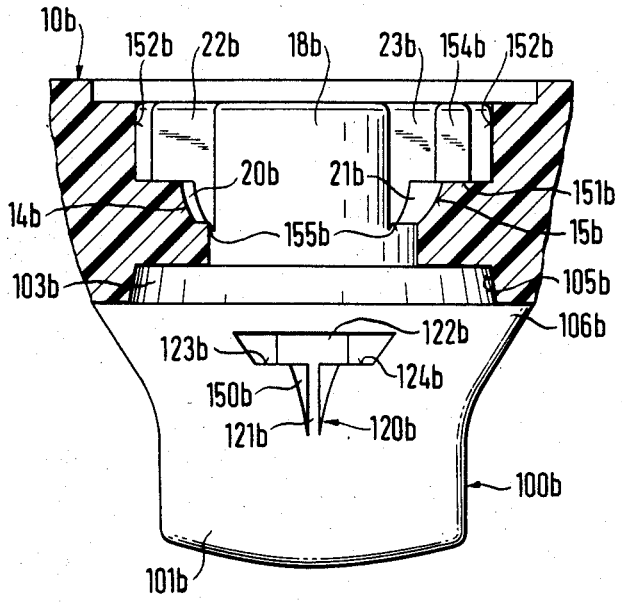
FIG. 9 shows a sectional view of a different embodiment of a cleat similar to that according to FIG. 2.

The insertion of a cleat **100*b* according to FIG. 9 into the socket as described takes place in the following way: The fastening portion 18*b* is brought into register with the opening contour according to FIG. 11. The cleat 100*b* is pushed into the socket until the conical extension 103*b* is accommodated by the recess 105*b*. Subsequently, the cleat 100*b* is rotated in a clockwise sense. During this operation the flat underside 151*b* of the projections 22*b*, 23*b* is running onto the obliquely upward sloping ramp 32*b*. Thereby the entire cleat is pressed against the sole 10*b* in a pressfit, from below. During the turning-in movement the projections 22*b*, 23*b* are running up against the radial elevation 158*b* elastically deforming it. Owing to the bores 159 the elevations 158 are flexible. After the projections 22*b*,23*b* have passed the elevations 158*b***, the latter will deform themselves back into the initial condition.

At this point of time the underside **151*b* of the projections 22*b*, 23*b* rests on the supporting surfaces 156*b*. The spherical mounting surfaces 20*b*, 21*b* of the fastening portion are lying in close contact against the spherical socket-shaped supporting surfaces 14*b*, 15*b* of the socket. The mounting surfaces 155*b* beneath the mounting surfaces 20*b*, 21*b* are resting on the shoulder 157*b***.

Figure 10:
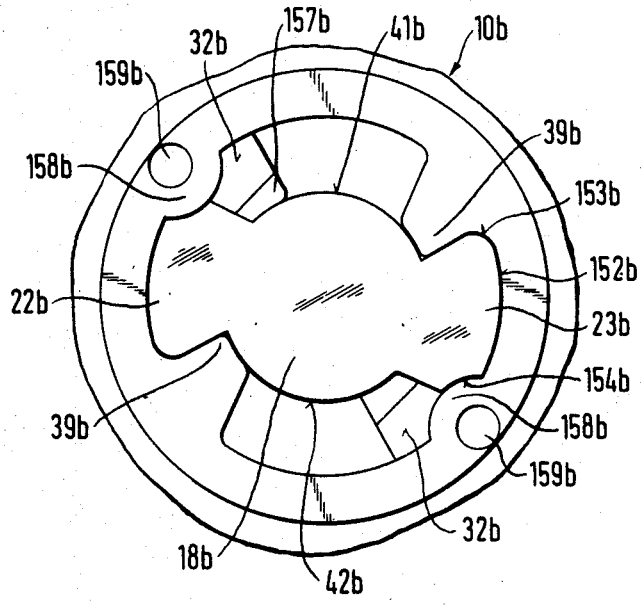
FIG. 10 shows a top plan view of the cleat in the socket according to FIG. 9.
Figure 11:
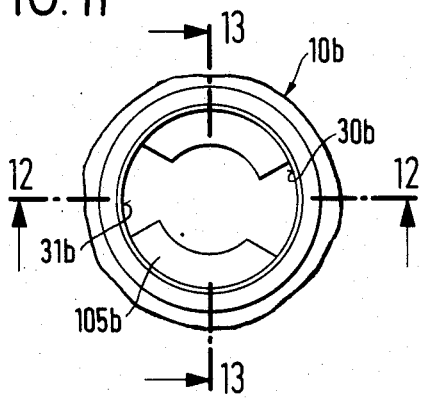
FIG. 11 shows a bottom plan view of a socket according to FIG. 9 without cleat.
Figure 12:
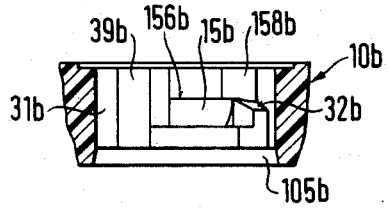
FIG. 12 shows a sectional view of the socket according to FIG. 11 taken along line 12—12.
Figure 13:
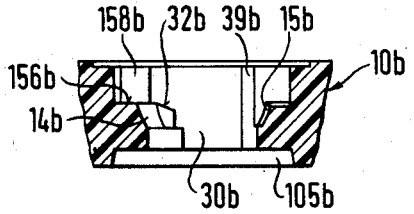
FIG. 13 shows a sectional view of the socket according to FIG. 11 taken along line 13—13.
Figure 14:
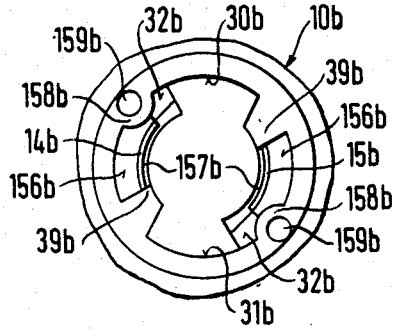
FIG. 14 shows a plan view taken on the socket according to FIG. 9 without cleat.

After having overcome the elevations **158*b* the groove 154*b* (of the projections 22*b*, 23*b*) comes to lie against them in snugly fitting relationship, as will be seen from FIG. 10. The entire projection is shaped in the outer contour thereof such that it is approximately positively seated in the space between the abutments 39*b* and the elevations 158*b*. The rounding at the edge 153*b* provides for a slow and steady deformation of the elevations 158*b* during the turning-in operation. The surfaces of the abutments 39*b* facing the cylindrical portions 41*b*, 42*b* likewise have a circular contour in cross section, in order to provide an additional supporting effect for the fastening portion 18*b*. As may be recognized, the fastening portion 18*b* is secured in a completely turned-in position, i.e. on the one side by the projections 22*b*, 23*b* lying in close contact against the abutments 39*b*, and to the other side through the radial elevations 158*b* which thus form a locking means against return rotation. Only after the application of a corresponding torque the fastening portion can be rotated back into a position in which the cleat 100*b*** may be removed out of the socket.

It is clear that the ball-shaped surfaces **14*b*, 15*b* in the socket and the spherical mounting surfaces 20*b*, 21*b* of the fastening portion in the shape may be shaped in the same manner as described for the corresponding surfaces in the embodiment according to FIGS. 1 to 8, whereby then an additional locking means against rotation is obtained. A locking means against unintentional rotation by the underside of the projections coming to lie in abutment against a ramp provided with a cutout as in the case of the previously described embodiment, is not provided for in the present embodiment. With the last-described embodiment, the projections 22***b*, 23*b* by coming to lie in abutment upon the supporting surfaces 156*b* take over an additional axial retention function.

Figure 15:
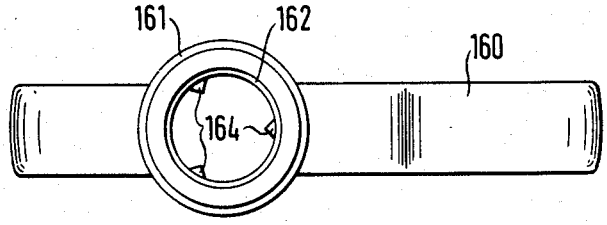
FIG. 15 shows a bottom plan view taken on a socket wrench from below to handle the cleats shown above.
Figure 16:
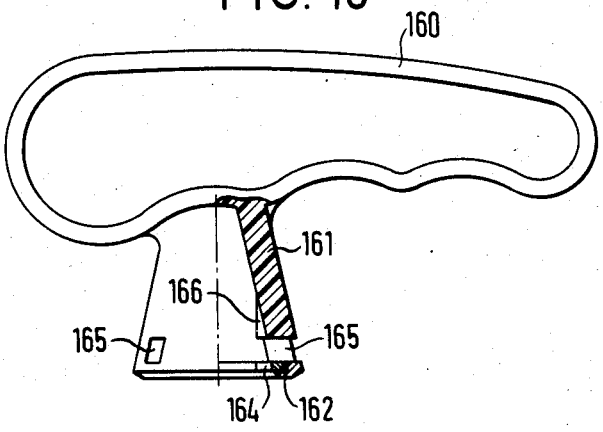
FIG. 16 shows a side view, partly in section, of the wrench according to FIG. 15.
Figure 17:
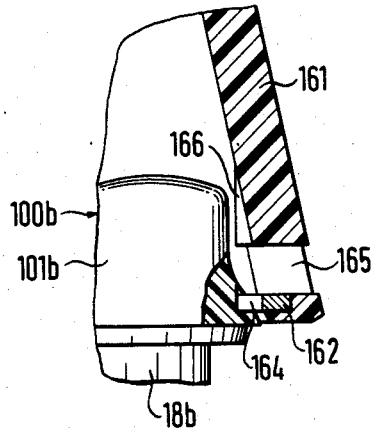
FIG. 17 shows a detail of the wrench according to FIGS. 15 to 16 being inserted into a cleat according to the invention.

FIGS. 15 to 17 show a wrench for mounting and demounting the cleats according to the preceding Figures. The wrench 15 to 17 comprises a handle portion 160 and a sleeve-like portion 161 which are formed in one piece of synthetic material. In the lower region of the conically downward enlarging sleeve section 161 a metal ring 162 is embedded. Said metal ring has three radially inward facing noses 164 in uniformly spaced circumferential arrangement. As will be seen from FIGS. 16 and 17, the sleeve-like portion 161 is provided with openings 165 above the noses 164. These openings 165 during the injection molding of the wrench have the purpose of preventing the ribs 166 from extending to the ring 162, rather to have the ribs 166 to terminate above the openings 165. Owing thereto, the noses 164 may readily be introduced axially into the grooves 121*b*, for example, and may engage within the transverse recess 122*b* and cooperate with the shoulders 123*b* and 124*b*, respectively, depending on the direction of rotation, in order to turn the cleat 100*b* in or out. In FIG. 17, the cleat 100*b* is shown in connection with the wrench. It is clear that also the cleat 100 may be actuated in the same manner.

The design of the recesses 120, 120*b* as described not only serves to apply a pulling force on the cleat 100, but also serves the purpose of having the wrench apply a sufficient torque during the insertion of the cleat 101, 101*b*, while being axially secured, and without any danger of slipping off. Because of the eccentric design of the spherical surfaces of the mounting and supporting surfaces 20, 21, 20*b*, 21*b*, and 14, 15, 14*b*, 15*b*, respectively, as well as at the elevations 158*b* a not insubstantial yet upwardly limited torque is necessary in order to bring the surfaces into contact with each other and to position the cleat.

I claim:

1. An improved cleat for sport shoes of the type in which a bayonet-type closure is accomplished between a socket situated in the shoe outsole and a cleat and in which the cleat contains a cleat body and a fastening attachment detachable from the socket and having two diametrically opposed spherical surface sections curving towards said cleat body, the improvement comprising: two diametrically opposed projections formed on said spherical surface sections away from said cleat, a cylindrical neck portion integrally formed between said two diametrically opposed spherical surface sections and a conical portion formed on said fastening attachment of said cleat, said socket having a key-shaped opening with a central opening and diametrically opposed paraxial slots for receiving said diametrically opposed spherical surface sections and associated projections, internally of said key-shaped opening a pair of spherical surface seating sections are provided at a quarter turn angle from said diametrically opposed paraxial slots and a pair of recesses shaped inwardly of seating sections are formed to nest said diametrically opposed projections, a pair of ramp surfaces are formed inwardly of said paraxial slots and terminate into said pair of recesses, said pair of ramp surfaces having identical arcuate shapes that complement each other and having the shortest distance between each other at the respective center of their arcuate shaped surfaces, a conical angular recess integral with the outer edge of said socket for receiving said conical portion integral with said cleat whereby said conical recess and said conical portion cooperate to absorb transverse stress between said cleat and said socket during use, and an annular collar integrally formed in a surrounding relation with said conical portion to abut against said outer edge of said socket.

* * * * *